United States Patent [19]

DeHove

[11] 3,950,976

[45] Apr. 20, 1976

[54] METHOD AND DEVICE FOR FORMING TUBES

[75] Inventor: Michel Roger DeHove, Mantes-la-Jolie, France

[73] Assignee: General Electronic Seet - G. E. S., Mantes-la-Jolie, France

[22] Filed: Dec. 12, 1974

[21] Appl. No.: 531,880

[52] U.S. Cl. ..... 72/128; 72/342; 72/370; 72/418

[51] Int. Cl.[2] ..... B21D 37/16; B21D 41/02

[58] Field of Search ..... 72/13, 342, 370, 418, 72/128, 393, 317; 425/393

[56] References Cited

UNITED STATES PATENTS

| | | | |
|---|---|---|---|
| 2,461,323 | 2/1949 | Hille | 72/342 |
| 3,161,756 | 12/1964 | Haverkamp | 72/342 |
| 3,354,695 | 11/1967 | Szente | 72/370 |
| 3,360,826 | 1/1968 | Lorang | 425/393 |
| 3,806,301 | 4/1974 | Osterhagen | 425/393 |
| 3,834,199 | 9/1974 | Rouyer | 72/38 |

*Primary Examiner*—C. W. Lanham
*Assistant Examiner*—E. M. Combs
*Attorney, Agent, or Firm*—Young & Thompson

[57] ABSTRACT

A mandrel mounted on a support and corresponding to the configuration of the tube to be formed is surrounded by an inductor placed at a distance which permits displacement and expansion of the tube on the mandrel under the action of pressure application means. The inductor carries a medium-frequency current which is maintained at a constant value during the forming operation in order to permit controlled annealing and plastic deformation of the tube.

15 Claims, 10 Drawing Figures

X
X'
F
5
6
6a
6b
7
8
9
10
11
12
13
14
14a
15
16
17
18
2
3
70
70a

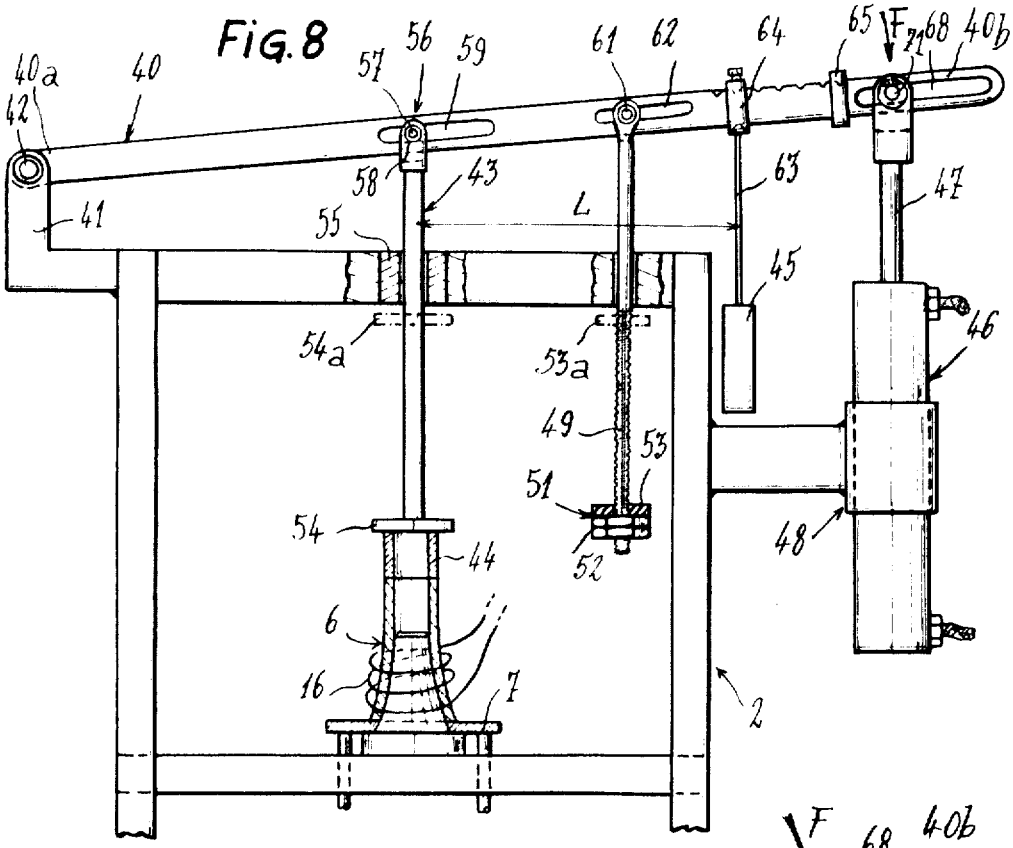
Fig. 8
40a
42
40
41
57
56
59
58
43
55
L
61
62
64
65
F
71
68
40b
63
47
45
46
54a
53a
49
53
51
52
54
44
48
6
16
7
2
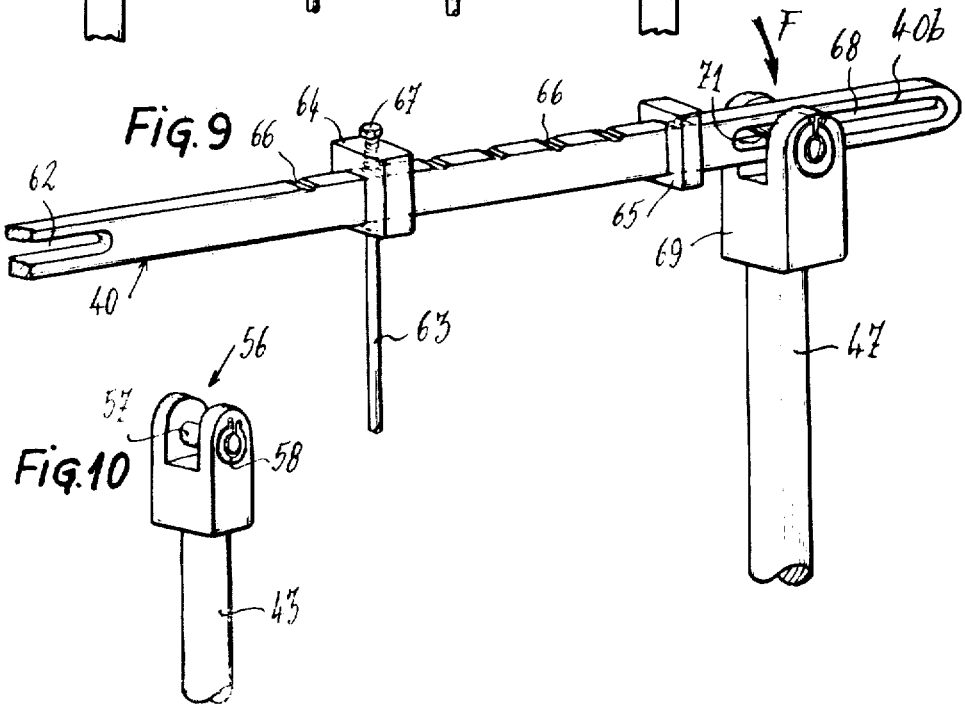
Fig. 9
F
68
40b
71
64
67
66
66
62
65
69
40
63
47
56
57
Fig. 10
58
43

METHOD AND DEVICE FOR FORMING TUBES

This invention relates to a method of forming tubes and especially metal tubes as well as to a device which is primarily intended to carry said method into effect.

The technique which has usually been employed up to the present time for the purpose of forming a tube generally consists in swaging the outside of the tube. Thus in order to give a conical shape to a tube for subsequent use as an acoustic horn, for example, said tube is swaged by hammering in order to reduce its diameter from one end to the other.

The swaging operation just mentioned entails the construction of machines which are both complex, costly and noisy. The level of noise during operation of these machines is such that they have to be partly buried underground and that the operators are obliged to wear sound-insulating helmets. Moreover, the hammering or swaging dies must be changed each time there is any dimensional modification of the tube to be formed and they can produce only cylindrical tubes which are flared at one end. This limits the field of application of the product obtained.

Since the swaging die comprises a set of hammers, the external and internal surfaces of the shaped tube after swaging are consequently provided with a large number of facets. It is therefore found necessary to complete the swaging process with a costly operation which involves polishing of the external surface of the tube whilst the facets of its internal surface cannot usually be rectified.

In an operation which is similar to external swaging, tapered metal tubes can also be produced by drawing in the known manner which consists in shaping the tubes externally and pulling these latter through dies which decrease in size.

Thus in order to obtain a tube of rectangular or square section from a tube having a circular section, there is initially formed a polygonal section which is progressively rectified in the successive dies of the series until the desired rectangular section is finally obtained.

The dies of these machines are very costly and the length of time taken to carry out the drawing operation imposes a severe limitation on the productivity of this process. Moreover, it is necessary to anneal the parts each time an operation is performed and this completely destroys the original state of the metal.

The aim of the invention is to overcome the above-mentioned disadvantages by making it possible to produce articles of better quality in an appreciably more economical manner.

The method of forming tubes and especially metal tubes in accordance with the invention consists in engaging inside the tube a mandrel corresponding to the configuration to be given to the tube, in heating the mandrel to a temperature which is sufficient to permit annealing and plastic deformation of the tube and, when this temperature is attained, in carrying out a relative sliding movement between the tube and the mandrel in order to anneal the tube and cause it to conform to the configuration of the mandrel by expansion over at least part of the length of said tube, whereupon the tube is separated from the mandrel. In accordance with the invention, said method essentially consists in heating the mandrel by means of a medium-frequency electric current and in maintaining the temperature of the mandrel at a constant value throughout the tube-forming period.

Heating of the mandrel by a medium-frequency current is particularly advantageous by reason of the rapidity achieved, the current frequency being preferably set at 150 kc/s.

The invention is also directed to a device which is primarily intended to carry out the method aforesaid and comprises means for forming a tube and discharging said tube after shaping.

The device in accordance with the invention for forming tubes and especially metal tubes comprises a metal mandrel mounted on a support and having a configuration corresponding to the intended configuration of the tube, means for heating said mandrel to a sufficient temperature to permit expansion of the tube on the mandrel and means for producing a relative sliding movement between the mandrel and the tube. In accordance with the invention, the device is distinguished by the fact that it comprises a medium-frequency electric circuit for heating the mandrel, that said circuit comprises an induction coil which surrounds the mandrel at a distance from this latter which is substantially greater than the thickness of the tube to be formed and that means are provided for regulating the temperature of the mandrel at a predetermined value during the tube-forming operation.

Heating by medium-frequency current achieves a higher degree of efficiency that any other process employed at the present time. Furthermore, the use of a multi-turn inductor which surrounds the mandrel makes it possible to localize the heating in a very accurate manner.

Further particular features and advantages of the invention will become apparent from the following description, reference being made to the accompanying drawings which are given by way of example and not in any sense by way of limitation, and wherein:

FIG. 8 is a view in elevation which is similar to FIG. 2 and shows a third embodiment of the device in accordance with the invention;

FIG. 9 is a view in partial perspective to a larger scale and showing the device of FIG. 8;

FIG. 10 is a view in partial perspective to a larger scale and showing a particular feature of the embodiment of FIG. 8.

Figures 1, 2, 3:
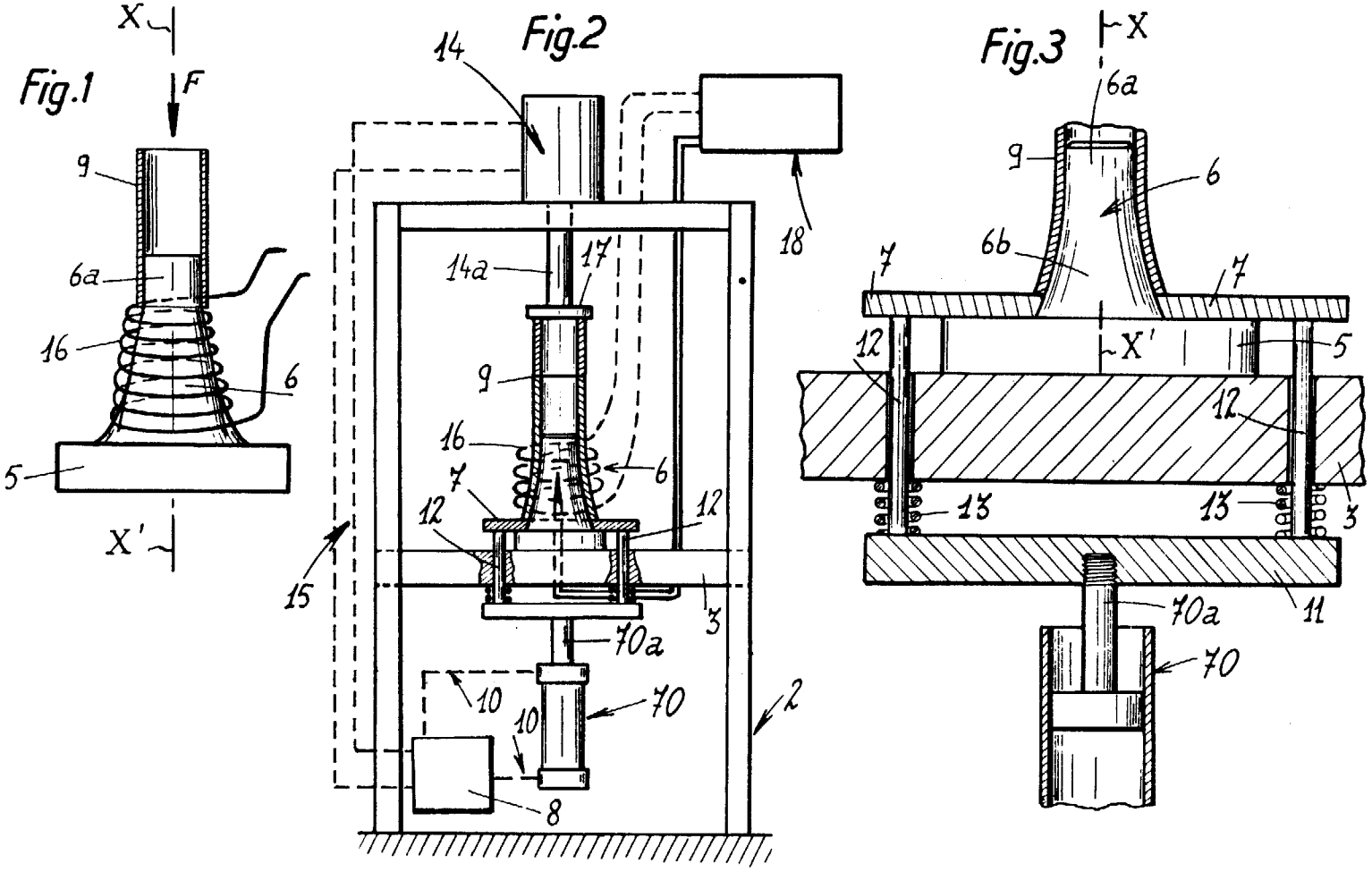
FIG. 1 is a simplified part-sectional view which illustrates the method in accordance with the invention.
FIG. 2 is a part-sectional view in elevation showing a first embodiment of the device in accordance with the invention.
FIG. 3 is a part-sectional view of the device of FIG. 2 to a larger scale and showing the means for supporting the mandrel.

In the embodiment of FIGS. 1 to 4, the device in accordance with the invention comprises an H-frame 2, provision being made on said frame for a transverse platform 3 for supporting a central base 5 on which is placed a mandrel 6. Said mandrel has a flared body **6*b* surmounted by a substantially cylindrical head 6*a*** having a vertical axis X-X'.

It is readily apparent that this configuration of the mandrel 6 is given only by way of example and can be of any type, depending on the particular geometry which may be chosen for the tube to be formed.

The base 5 carries an extractor plate 7 provided with a central opening through which the mandrel 6 can be inserted within said plate 7. Metallic rods 12 which pass through the platform 3 connect the extractor plate 7 to a sole-plate 11 which is mounted beneath the platform 3, restoring springs 13 which are coaxial with the rods 12 being interposed between the platforms 3 and the sole-plate 11.

A double-acting jack 70 which is preferably of the hydraulic type is mounted beneath the sole-plate 11, the operating rod **70*a* being approximately coaxial with the axis X—X' and rigidly fixed to the sole-plate 11 by screwing, for example. The jack 70 is supplied by a hydraulic unit 8 and is connected to this latter by means of pipes which are represented diagrammatically by dashed lines 10.**

A second double-acting jack 14 supplied by the hydraulic unit 8 by means of pipes 15 is mounted at the top of the frame 2. The operating rod **14*a* of said second jack is coaxial with the vertical axis X—X' and carries a circular end-plate or bearing-plate 17.**

When a tube 9 to be formed is positioned over the head **6*a* of the mandrel 6, the operation of the jack 14 has the effect of causing the bearing plate 17 to thrust the tube 9 over the mandrel 6.**

Figures 4, 5, 6, 7:
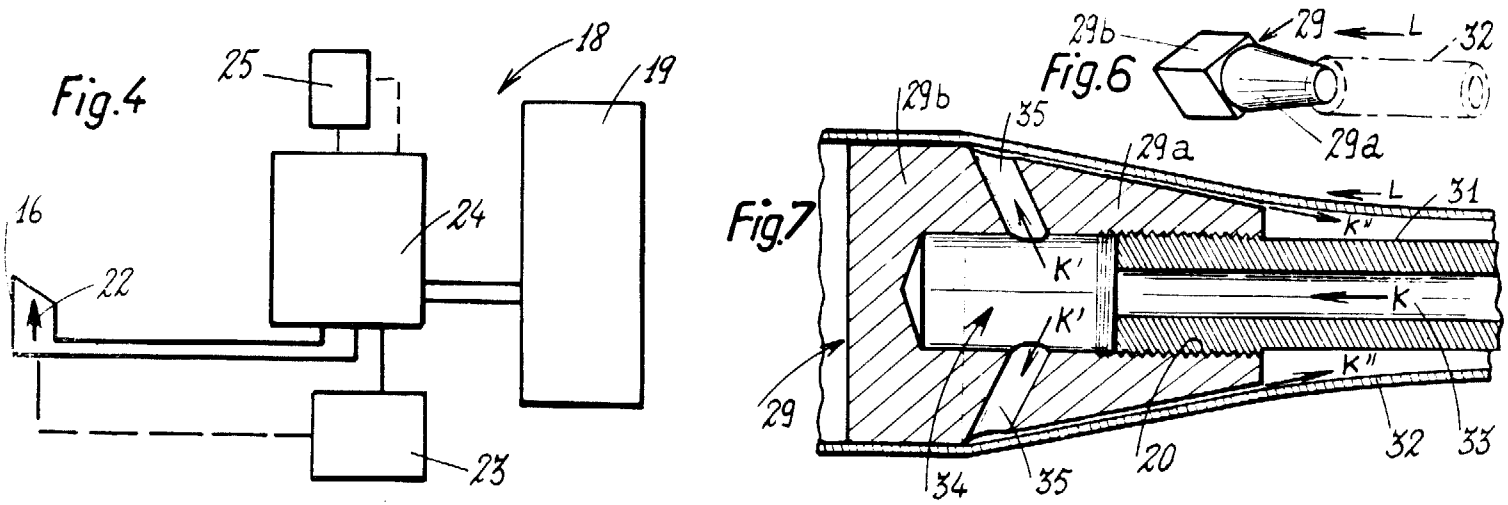
FIG. 4 is a block diagram of the electric circuit employed for heating the mandrel.
FIG. 5 is a view in partial elevation and axial cross-section showing a second embodiment of the device contemplated by the invention and applied to the drawing of tubes.
FIG. 6 is a simplified view in partial perspective which essentially shows the mandrel of the embodiment of FIG. 5.
FIG. 7 is a part-sectional view to a larger scale showing the device of FIG. 5.

In accordance with one particular feature of the invention, the device comprises an electric circuit 18 for medium-frequency heating of the mandrel 6. The circuit 18 comprises on the one hand an inductor 16 constituted by turns of wire surrounding the flared portion **6*b* of the mandrel 6 at a distance from this latter which is substantially greater than the thickness of the tube 9 to be formed and, on the other hand (as shown in FIG. 4), a probe 22 for regulating the temperature of the mandrel 6 and placed within the interior of said mandrel. The probe 22 controls an amplifying stage 23 associated with an electronic regulator 24 which is known per se and controls a regulating motor 25, preferably of the potentiometric type. The regulator 24 is also connected on the one hand to a medium-frequency generator 19 and on the other hand to the inductor 16.**

The height of the platform 3 is adjustable as a function of the length of the different tubes to be formed.

So far as the application of the method according to the invention is concerned, the operation of this device is as follows:

When the rod **14*a* of the jack 14 has been withdrawn, the tube 9 to be formed is engaged over the head 6*a* of the mandrel 6 (as shown in FIG. 1). Assuming that the flared body 6*b* of the mandrel 6 has the configuration which it is desired to give to the tube 9, the mandrel 6 is first heated by turning-on the medium-frequency generator 19. The mandrel 6 is thus heated to a sufficient temperature to carry out annealing of the tube 9 and to permit plastic deformation of this latter. This temperature is clearly dependent on the nature of the constituent material of the tube 9.** For example, in the case of brass corresponding to the standard UZ 36, the requisite temperature is 650° to 700° C.

When this temperature is attained, the jack 14 is actuated so as to thrust the tube 9 over the mandrel 6. Since said mandrel clearly remains stationary, a relative sliding movement is thus carried out between the tube 9 and the mandrel 6. During this movement, the tube 9 is annealed and closely conforms to the configuration of the body **6*b* of the mandrel 6 by expansion. This expansion can be carried out over only part of the height of the body 6*b* of the mandrel 6 or over the entire height. Correlatively, the tube 9** can therefore be expanded either partly or totally as a function of its length.

In the example described, the forming of the tube 9 is continued until the extremity of said tube which is in contact with the mandrel 6 comes into contact with the extractor plate 7 (as shown in FIGS. 2 and 3). If necessary, the expansion of the tube 9 could be continued beyond this stage, in which case the periphery of the extremity of said tube 9 which is in contact with the extractor plate 7 would accordingly assume the shape of a flattened ring.

When the extremity of the tube 9 begins to penetrate between the inductor 16 and the mandrel 6 under the action of the thrust applied by the jack 14, said tube 9 forms a Faraday cage for that portion of the inductor 16 which is located opposite, thus modifying the efficiency of the inductor 16 to a considerable extent. The temperature of that portion of the mandrel 6 which is covered by the tube 9 at this stage accordingly tends to decrease.

The regulating probe 22 makes it possible to correct this temperature variation in order to maintain the temperature at its reference value. The probe transmits a signal to the amplifying stage 23 which in turn transmits the signal to the regulator 24. In a manner which is known per se, said regulator comprises two relays having proportional, integral and derived action which control the potentiometric motor 25.

The regulator 24 modifies the current intensity in the generator 19 and transmits this corrected intensity to the inductor 16, thus restoring the temperature of the mandrel 6 to its reference value. Continuous and uniform forward motion is imparted correlatively to the tube 9. The temperature of the mandrel 6 is thus regulated during the entire period of downward travel of said tube over the flared body **6*b*** of said mandrel.

On completion of this operation, the rod **14*a* of the jack 14 is lifted and the jack 70 is actuated. The sole-plate 11 which is secured to the rod 70*a* of the jack 70 is then subjected to an upward thrust which is transmitted to the extractor plate 7 by the connecting rods 12. The plate 7 is therefore lifted, the tube is accordingly withdrawn from the mandrel 6** and can then be discharged to a cooling station.

After withdrawal of the tube 9 from the mandrel 6, the ejecting jack 70 is actuated in the opposite direction in order to bring the extractor plate 7 into contact with the base 5. The restoring springs 13 then move the sole-plate 11 away from the platform 3 and return said sole-plate to its initial position.

If the tube 9 is formed of metal, a work-hardened initial state is preferably chosen.

It has in fact been found that a work-hardened state endows the blank which constitutes the tube to be formed with higher resistance to the thrust applied by the jack 14 and to extraction by the jack 70 as well as higher general strength during the forming operation.

The annealing action to which the deformed portion of the tube 9 is subjected as it progresses over the mandrel 6 has the effect of softening the metal or alloy of which said tube 9 is formed. However, the expansion of the metal which takes place at the same time as said annealing process increases the internal tension within the metal and largely compensates for the annealing effects.

It is consequently found that, after expansion on the mandrel 6 and cooling, the metal or alloy of the tube 9 is practically restored to its work-hardened state and to its original value of hardness.

The mandrel 6 must be formed of material which is suited to heating by medium-frequency current. This material must accordingly have high resistivity in order to permit satisfactory efficiency of the generator 19 and to become oxidized as little as possible while it is being heated. High resistance to wear is also desirable.

Researches have made it possible to establish the fact that these requirements are met by the special nickel-chromium steels.

In point of fact, nickel confers high resistivity on steel whilst chromium endows it with excellent resistance both to wear and to oxidation.

Tests have shown that particularly advantageous results were obtained with a nickel-chromium steel having the following composition (the percentages being expressed by weight): Fe: 54% — Cr: 25% — Ni: 20% — Si: 0.5% — C: 0.5%.

NUMERICAL EXAMPLE

By way of numerical example, the application of the method in accordance with the invention will be explained hereinafter with reference to the expansion of a cylindrical blank formed of brass.

It has been found that the expansion of a brass blank on a mandrel such as the mandrel 6 cannot take place if the brass contains an appreciable percentage of lead. This finding can be explained by the fact that lead reduces the ductility of brass and consequently its expansibility. A brass which is practically free from lead and in the work-hardened state such as brass of the type known as UZ 36 (AFNOR standard).

By way of example, the dimensions of the cylindrical blank are as follows:

height: 180 mm
internal diameter: 16 mm
external diameter: 18 mm

The mandrel is chosen so as to have a cylindrical head which can be engaged within said blank, a substantially frusto-conical flared body such as the body **6*b* which is shown in FIGS. 1 to 3, and an end-portion having an approximately exponential profile. The mandrel is formed of nickel-chromium steel having a composition which is preferably identical to that mentioned in the foregoing. The dimensions of the mandrel corresponding to said blank are as follows: a diameter of 120 mm at the base and a height of 130 mm. The frequency of the current delivered by the generator 19 is set at a value of approximately 150 kc/s, the power rating of the generator 19** being 10 kVA.

The blank is placed in position over the head of the mandrel and heating of the mandrel is then initiated, a temperature of 700° C being attained in approximately 30 seconds. The blank is then forcibly displaced over the mandrel, thus causing the expansion of said blank over approximately two-thirds of its height at a rate of substantially 0.50 meter per minute. The lower end approximately exponential portion of the tube which is formed has a height of approximately 90 mm. The internal diameter of the tube between the frusto-conical portion and its exponential portion is substantially 40 mm whilst the internal diameter of the mouth of the tube is 110 mm.

A surprising result which has been found is that the thickness of the tube at the point of its largest diameter after expansion is equal to its original thickness. In consequence, the initial strength of the tube which is thus shaped is fully retained.

This advantageous result can be explained as follows: after the beginning of the forming operation, the expansion of the metal of the blank takes place by reduction of the height of the tube progressively as this latter moves downwards over the mandrel. More precisely, it appears that there is a transition between the first and the second forming stages when the angle between the tangent to a generating-line of the tube 9 and the axis X—X′ of said tube 9 exceeds approximately 4°.

It is in fact wholly surprising to note that the method according to the invention is carried out in a particularly satisfactory manner when the frequency of the current delivered by the generator is set at a value of approximately 150 kc/s and this holds true regardless of the type of metal employed in the manufacture of the tube 9.

It has also been found in the case of a given configuration and a given alloy that, irrespective of the height of the tube, the reduction in height of said tube is proportional to the difference in diameters obtained after expansion.

The method and the device in accordance with the invention offer further advantages in addition to those already mentioned, viz:

The turns of the inductor 1 form an enclosed space having a contour which embraces the contour of the body **6*b* of the mandrel 6 at a short distance from this latter. This arrangement ensures very good distribution of heat over the mandrel 6**.

Furthermore, since the uppermost turn of the inductor 16 does not pass beyond the top level of the expanded portion of the tube 9, only said expanded portion is subjected to annealing. Any waste of heat energy is therefore prevented as well as harmful annealing of the non-expanded portion of the tube 9.

The use of a medium-frequency electric circuit in conjunction with the use of turns forming the inductor 16 makes it possible on the one hand to achieve highly localized heating as already mentioned but also make it possible on the other hand to reduce surface oxidation of the mandrel 6 to a very appreciable extent. Moreover, this type of heating is considerably faster than ordinary resistance heating.

As has in fact been seen in connection with the numerical example given in the foregoing, the mandrel 6 attains a temperature of 700° C in only 30 seconds. This temperature can be attained in 8 seconds at the time of forming of the following tube.

Heating by medium-frequency current is also particularly advantageous in comparison with flame-torch heating, for example, since it prevents the formation of scale on the mandrel 6.

The system consisting of the jack 70, the sole-plate 11, the connecting rods 12 and the extractor plate 7 permits ready withdrawal of the tube 9 from the mandrel 6 after expansion.

The thermal regulation probe 22 maintains the temperature of the mandrel 6 at the desired constant value progressively as the tube 9 moves downwards and consequently ensures satisfactory and uniform performance of the tube expansion process.

In the embodiment which is illustrated in FIGS. 5 to 7, the tube 32 to be shaped is engaged horizontally between two upright members 27*a*, 27*b* of a supporting frame 26. The upright member 27*a* is capable of displacement in a direction parallel to the axis Y—Y′ of the tube 32 and is maintained against said tube by an elastic restoring member such as a spring 36.

In this example, the mandrel 29 has a frusto-conical portion 29*a* extended by a square-section rectangular parallelepiped 29*b*.

The mandrel 29 is attached to the extremity of a rod 31 which is mounted within the interior of the tube 32 in coaxial relation to this latter. In the embodiment which is illustrated, the mandrel 29 is accordingly provided with an internally-threaded axis bore 20 in which is screwed the extremity of the rod 31.

Said rod is connected to a traction unit (not shown) which preferably consists of a hydraulic jack, for example, and is capable of displacing the rod 31 in the direction of the arrow G along the axis Y—Y′.

The traction rod 31 has an axial duct 33 which opens into a chamber 34 formed within the interior of the mandrel 29. The chamber 34 communicates with the periphery of the mandrel 29 by means of drilled passageways 35 which have their openings substantially at the base of the frusto-conical portion 29*a*.

As in previous embodiment, the inductor 28 is constituted by hollow turns which are wound around the mandrel 29 along the frusto-conical portion 29*a* of this latter. Said turns are cooled by a circulation of water within the internal passageways or ducts 28*a* which are formed by said turns.

The inductor 28 is capable of displacement along the axis Y—Y′ in the direction of the arrow G′ by making use of means which are known per se and have therefore been omitted from the drawings.

The operation of this embodiment is as follows: the tube 32 to be shaped is engaged between the upright members 27*a*, 27*b* and is held in position between these latter by the restoring spring 36. In addition, the inductor 28 is placed at a sufficient distance from the periphery of the tube 32, taking into account the cross-sectional dimensions of the parallelepiped 29*b*.

The rod 31 is screwed into the mandrel 29, is slidably mounted through the upright members 27*a*, 27*b* in which openings are formed for this purpose, and said rod is then connected to its traction jack. Since the inductor 28 takes up the position shown in FIG. 5 and the mandrel 29 is partially engaged within the tube 32, the medium-frequency heating operation is then initiated.

When the mandrel 29 attains its reference temperature, traction of said mandrel by the rod 31 is then initiated and said mandrel then penetrates entirely within the tube 32. At the same time, a neutral gas such as argon is injected into the duct 33 in the direction of the arrow K.

Said gas passes into the chamber 34 and into the passageways 35 (in the direction of the arrows K′).

The flow of said gas between the tube 32 and the parallelepipedal base 29*b* of the mandrel 29 is made practically impossible by the pressure of the tube 32 which closely conforms to the contour of the parallelepiped 29*b*. On the other hand, the gas flow separates the tube 32 very slightly from the frusto-conical portion 29*a*, thus permitting the neutral gas to penetrate between the tube 32 and the frusto-conical portion 29*a* of the mandrel.

The gas then flows freely around the tube 31 (as shown by the arrows K″).

There is thus formed a gas cushion between the frusto-conical portion 29*a* and the tube 32. Said gas cushion facilitates the sliding motion of the tube 31 over the mandrel 29 and prevents any incipient scale formation on the mandrel 29 by circulating oxygen around the surface of said mandrel.

As in the embodiment of FIGS. 1 to 4, the introduction of the tube 32 between the inductor 28 and the mandrel 29 gives rise to a Faraday cage effect and a correlative decrease in the temperature of the mandrel 29.

When the mandrel 29 has reached the position shown in FIG. 7 or in other words when it is fully engaged within the tube 32, the temperature of the mandrel is restored by hand to the reference temperature by adjusting the medium-frequency generator (not shown) to which the inductor 28 is connected.

Said inductor is displaced in the direction of the arrow G′ while the mandrel 29 progresses at the same time in the direction of the arrow G and while ensuring that the inductor 28 constantly surrounds the frusto-conical portion 29*a*.

During this progression, it is not necessary to carry out corrections of temperature of the mandrel 29 which remains at its reference value after the adjustment mentioned above. The thermal regulation by means of a probe as described in the embodiment of FIGS. 1 to 4 is therefore no longer necesssary in this case.

When the mandrel 29 reaches the upright member 27*a*, said member is moved away and withdrawn after being expanded to a square cross-section corresponding to that of the parallelepiped 29*b*.

Tests have shown that argon is of special interest as a gas for the protection of the mandrel 29. It has in fact been found that the use of this gas removes any danger of explosion which might otherwise occur when another gas is placed in contact with the grease which is often present as a coating on the tube 32 to be formed.

In the embodiment shown in FIGS. 8 to 10, the forming device in accordance with the invention is advantageously provided with means for exerting a constant thrust on the tube to be formed throughout the period of downward motion of said tube over the mandrel 6.

In accordance with this embodiment, the means aforementioned comprise a metallic lever-arm 40, the extremity 40*a* of which is pivotally mounted on a bearing-arm 41 of the frame 2 and capable of rotating about a spindle 42 which is practically horizontal. The lever-arm 40 is also pivotally coupled in the central portion thereof with a rod 43 which is intended to exert thrust on the tube 44 around the mandrel 6.

The lever-arm 40 is adapted to carry in the vicinity of the extremity 40*b* which is remote from the extremity 40*a*, a weight 45 whose value is chosen correlatively with the value of the thrust to be exerted on the tube 44. As a complementary feature, the device comprises a vertical jack 46 which is preferably a hydraulic jack and is pivotally coupled with the extremity 40*b* of the lever-arm 40 by means of the operating rod 47 of said jack. In the example which is illustrated, the jack 46 is engaged in a tubular support 48 which is attached to the frame 2.

The arm 40 carries a vertical slide-rod 49 which is capable of sliding through the top portion of the frame 2, the lower end of said rod being fitted with an adjustable stop 51 which is intended to limit the amplitude of upward motion of the thrust rod 43. The stop 51 comprises a nut 52 which is screwed onto the end portion of the slide-rod 49 and carries a washer 53 formed of elastic material such as rubber.

A plate 54 is carried by the lower end of the thrust rod 43 and serves to displace the tube 44. The rod 43 is capable of sliding through the top portion of the frame 2 within a bearing-bush 55 which is coaxial with the rod 43 and fixed internally within the frame 2.

The bearing-bush 55 can be constituted especially by a cylindrical bronze ring, the rod 43 being capable of sliding with slight play within the bore of said ring.

As shown in FIG. 10, the top end portion of the thrust rod 43 has a U-shaped section 56 within which is engaged the lever-arm 40. As a complementary feature, the arms of the U-section are connected together by means of a spindle 57 which is fitted at each end with a retaining-ring 58 and passes through an elongated slot 59 formed longitudinally within the lever-arm 40, as shown in FIG. 8.

The upper extremity of the slide-rod 49 is pivotally coupled with the lever-arm 40 by means of a system which is similar to that of FIG. 10, only a ring 61 and the longitudinal slot 62 of this system being visible in FIG. 8. The end portion 69 of the operating rod 47 of the jack 46 has a U-section fitted with a transverse spindle 71 which is slidably mounted within an elongated slot 68 formed internally at the extremity **40*b* of the lever-arm 40**.

The weight 45 is suspensed by means of a rod 63 from a collar 64 which is slidably mounted around the lever-arm 40. The collar 64 is displaceable along said lever-arm between an end-of-travel stop 65 located in the vicinity of the extremity **40*b* of the lever-arm 40, and a series of stop-notches 66 which are formed along the lever-arm 40 at uniform intervals. By way of example, provision can be made for six stop-notches 66**.

A cone-point set-screw 67 which is mounted through the collar 64 serves to lock this latter in any desired position on the lever-arm 40.

The operation of this device is as follows: the pivoted lever-arm 40 is previously maintained in the top position corresponding to the positions **54*a* and 53*a* respectively of the plate 54 and of the washer 53 as shown in chain-dotted lines, the operating rod 47 of the jack 46 being completely withdrawn. The weight 45 is chosen so as to have a value corresponding to the value of the thrust to be exerted on the tube 44. A fine adjustment of the thrust moment is then carried out by suitably positioning the collar 64 on the lever-arm 40 in one of the stop-notches 66. This adjustment determines the leverage L between the weight 45 and the thrust rod 43**.

The aforementioned means for retaining the lever-arm 40 are then withdrawn, thus initiating a movement of rotation in a vertical plane about the pivot-pin 42 (as shown by the arrow F). Correlatively, the rod 43 exerts a thrust on the tube 44 which moves downwards around the mandrel 6 whilst the spindle 57 slides within the longitudinal slot 59. At the same time, the slide-rod 49 and the rod 47 move downwards and their spindles (not shown) slide within the elongated slots 62 and 68.

It is shown by experience that, when the base of the tube 44 reaches the flared body **6*b* of the mandrel 6 (as shown in FIG. 3), there is an appreciable increase in the speed of downward motion of the tube 44 by reason of the additional quantity of material which is necessary for expansion of the tube up to a given height. The speed of downward motion is thus related to the desired configuration of the tube 44 but also and especially to the nature of the alloy employed in the manufacture of the tube as well as to the temperature to which this latter is heated. The force applied to the tube 44 by the plate 54 and the rod 43** by means of the articulated system described in the foregoing remains strictly constant whilst the downward motion accelerates.

The embodiment of FIGS. 8 to 10 thus prevents any reduction in thrust exerted on the tube 44 during the entire downward motion since the only consequence of such a reduction would be to affect the satisfactory performance of the method according to the invention.

The means employed for pivotally attaching the rods 43 and 49 to the lever-arm 40 additionally serve to remove any danger of twisting and jamming of said rods 43, 49 as these latter pass through the frame 2.

When the downward motion of the tube 44 is completed, the lever-arm 40 and the rods 43, 49 are lifted by operating the hydraulic jack 46. The amplitude of upward motion of the complete assembly is limited by the washer 53 which comes into abutting contact with the top portion of the frame 2 at the end of travel (top position **53*a***).

The distances of travel of the rods 43 and 49 are equal and can be adjusted by placing the nut 52 in the required position on the threaded end portion of the rod 49.

Solely by way of indication, it is possible to construct two devices in accordance with the invention and having the following characteristics:

a. in the case of a tube 44 to be expanded, the length of which is within the range of 50 to 500 mm and the diameter of which is within the range of 100 to 300 mm approximately, the distance of travel of the rods 43 and 49 ranges from 0 to 500 mm whilst the power rating of the generator 19 is 10 kVA. The thrust of the lifting jack 7 is approximately 2000 kg.
b. In the case of a tube 44 to be expanded, the length of which is within the range of 50 to 1000 mm approximately and the diameter of which is within the range of 100 to 500 mm, the distance of travel of the rods 43 and 49 ranges from 0 to 1000 mm, whilst the power rating of the generator 19 is 20 kVA. The thrust of the lifting jack 7 is approximately 3000 kg.

The foregoing characteristics are given solely by way of example and can clearly vary as a function of the characteristics of the tube to be expanded and those of the mandrel 6.

After expansion, the upward motion of the tube 44 can be carried out either at a speed which is substantially equal to the speed of downward motion or at a distinctly lower speed. Provision can also be made for interruptions of motion during the downward travel and/or during the upward travel of the tube.

Control of the hydraulic jacks 46 and 7 is preferably carried out by means of a portable control unit which is connected to the device by means of a flexible cable.

Tests have shown that the device in accordance with the invention is capable of performing a large number of operations without any failure and is therefore highly reliable.

It is readily apparent that the invention is not limited to the examples described in the foregoing and can extend to alternative forms of execution. Thus, when the volume of the mandrel 6 is too small to permit the introduction of a thermal regulation probe, an optothermal probe can be placed outside the mandrel, this type of probe being known per se.

Furthermore, the tubes to be expanded are not limited to metallic tubes but can also be of plastic material; it must clearly be ensured in that case that the heating temperature of the mandrel (6, 29) is suited to the material of which the tube is made. The embodiment which is illustrated in FIGS. 8 to 10 can be replaced by any other system which would also make it possible to maintain a strictly constant thrust on the tube 44 during the entire downward motion of this latter over the mandrel. In particular, the spindle 57 could be replaced by a roller which runs within the elongated slot 59 and the weight 45 could be varied by adding or withdrawing weights fitted over the rod 63.

By virtue of a wide variety of possible configurations, tubes which are expanded by means of the method and device according to the invention find an extremely wide range of potential applications such as acoustic horns, chair or table legs, vehicle headlamp reflectors, medical probes and so forth.

I claim:

1. A device for forming metal tubes, comprising a metal mandrel with a flared body mounted on a support and having a configuration corresponding to the intended configuration of the tube, means for heating said mandrel to a temperature sufficient to permit expansion of the tube on the mandrel and means for producing a relative sliding movement between the mandrel and the tube, wherein said device comprises a medium-frequency electric circuit for heating the mandrel, wherein said circuit comprises an inductor having a plurality of turns, said turns surrounding the flared body of the mandrel at a distance therefrom which is substantially greater than the thickness of the tube to be formed, and wherein means are provided for regulating the temperature of the mandrel at a predetermined value during the tube-forming operation.

2. A device according to claim 1, wherein the mandrel is rigidly fixed to the support which is stationary and wherein said device comprises first jack means for forcibly displacing the tube around the mandrel and second jack means for ejecting the tube after shaping on the mandrel.

3. A device according to claim 1, wherein said device comprises a tube-supporting frame comprising two upright members, one member being displaceable and subjected to an elastic restoring element for maintaining said member against the tube, and wherein the mandrel is attached to the extremity of a rod mounted coaxially with the tube and connected to traction means.

4. A device according to claim 3, wherein the traction rod of the mandrel has an axial duct through which is injected a gas such as argon for protecting the surface of the mandrel, said duct being so arranged as to open into a chamber which is formed within the interior of the mandrel and communicates with the periphery of said mandrel through at least one drilled passageway opening within the flared part of said mandrel.

5. A device according to claim 1, wherein the mandrel is made of steel having high resistivity and sufficient resistance to wear such as a nickel-chromium steel containing about 25% chromium, 20% nickel and 0.5% carbon by weight, balance essentially iron.

6. A device according to claim 1, wherein the mandrel is rigidly fixed to the support which is stationary and wherein said device comprises means whereby a thrust of constant magnitude is exerted on the tube throughout the period of motion of the tube over the mandrel.

7. A device according to claim 1, and means for regulating the temperature of the mandrel, said means comprising probe means for controlling the power supplied to said inductor by said generator, said probe means being connected to said medium-frequency circuit and being located outside the mandrel and comprising an optothermal probe.

8. A device for forming metal tubes, comprising a metal mandrel with a flared body mounted on a support and having a configuration corresponding to the intended configuration of the tube, means for heating said mandrel to a temperature sufficient to permit expansion of the tube on the mandrel and means for producing a relative sliding movement between the mandrel and the tube, wherein said device comprises a medium-frequency electric circuit for heating the mandrel, wherein said circuit comprises an inductor having a plurality of turns, said turns surrounding the flared body of the mandrel at a distance therefrom which is substantially greater than the thickness of the tube to be formed, wherein means are provided for regulating the temperature of the mandrel at a predetermined value during the tube-forming operation, wherein the mandrel is rigidly fixed to the support which is stationary and wherein said device comprises means whereby a thrust of constant magnitude is exerted on the tube throughout the period of motion of the tube over the mandrel, wherein said means comprise a lever-arm having one extremity rotatably mounted on the support for pivotal motion about a substantially horizontal axis and adapted to carry in the central portion thereof a rod for forcibly displacing the tube around the substantially vertical mandrel, and wherein the lever-arm carries in the vicinity of the extremity which is remote from the pivoted extremity a weight corresponding in value to the thrust to be exerted on the tube.

9. A device according to claim 8, wherein the top end portion of the thrust rod has a U-section in which the lever-arm is engaged, and wherein the arms of the U are joined together by a spindle which passes through an elongated slot formed lengthwise in said lever-arm.

10. A device according to claim 8, wherein said device comprises a jack for lifting the lever-arm at the extremity opposite to the lever-arm extremity which is pivoted on the support, and wherein said jack is rigidly fixed to said support.

11. A device according to claim 8, wherein the lever-arm carries a vertical slide-rod which passes through the upper portion of the support and is fitted at the lower end thereof with an adjustable stop for limiting the amplitude of upward motion of the thrust rod.

12. A device according to claim 8, wherein the weight is suspended from a collar which is displaceable along the lever-arm between an end-of-travel stop located in the vicinity of the extremity of said lever-arm and at least two stop-notches provided for the collar and formed on said lever-arm.

13. A method of forming metal tubes as intended primarily to be carried out by means of the device according to claim 1, wherein said method consists in engaging inside the tube a mandrel with a flared body corresponding to the configuration to be given to the tube, heating the mandrel to a temperature which is sufficient to permit annealing and plastic deformation of said tube and, when this temperature is attained, carrying out a relative sliding movement between the tube and the mandrel in order to anneal the tube and cause it to conform to the configuration of the mandrel by expansion over at least part of the length of said tube, whereupon the tube is separated from the mandrel, said heating of said mandrel being effected by means of an induction heater operating on a medium-frequency electric current and maintaining the temperature of said flared body of said mandrel at a substantially constant value throughout the tube-forming period.

14. A method according to claim 13, wherein the frequency of the current is approximately 150 kc/s.

15. A method according to claim 13, wherein a protective gas such as argon is injected adjacent the flared body and between the mandrel and the tube.

* * * * *